US007694391B2

(12) United States Patent
Skillas

(10) Patent No.: US 7,694,391 B2
(45) Date of Patent: Apr. 13, 2010

(54) ERGONOMIC HANDLE PROVIDING HORIZONTAL AND VERTICAL GRIPPING SURFACES

(76) Inventor: Maria Skillas, 3072 Rockaway Rd., Atlanta, GA (US) 30341

( * ) Notice: Subject to any disclaimer, the term of this patent is extended or adjusted under 35 U.S.C. 154(b) by 1104 days.

(21) Appl. No.: 10/691,977

(22) Filed: Oct. 24, 2003

(65) Prior Publication Data

US 2004/0107544 A1 Jun. 10, 2004

Related U.S. Application Data

(60) Provisional application No. 60/420,791, filed on Oct. 24, 2002.

(51) Int. Cl.
*A45F 5/00* (2006.01)

(52) U.S. Cl. ..... 16/430; 16/431

(58) Field of Classification Search ..... 16/110.1, 16/422, 425, 426, 430, 436, 440, 435; 30/340, 30/341, 526, 374
See application file for complete search history.

(56) References Cited

U.S. PATENT DOCUMENTS

| | | | | | |
|---|---|---|---|---|---|
| 2,263,136 | A | * | 11/1941 | Knouse et al. | 30/374 |
| 2,325,434 | A | | 7/1943 | Stiles | |
| 2,477,150 | A | | 7/1949 | Snyder et al. | |
| 2,789,799 | A | | 4/1957 | Kaufman | |
| 4,263,690 | A | * | 4/1981 | Dobosi | 15/145 |
| 4,495,669 | A | | 1/1985 | Hooper | |
| 5,044,083 | A | * | 9/1991 | DeCarolis et al. | 30/510 |
| D337,667 | S | * | 7/1993 | Lovett | D7/379 |
| D344,228 | S | * | 2/1994 | Woolf | D8/320 |
| 5,343,589 | A | * | 9/1994 | Davenport | 15/257.4 |
| 5,440,784 | A | | 8/1995 | Hull et al. | |
| 5,522,659 | A | | 6/1996 | Penaranda et al. | |
| 5,772,823 | A | * | 6/1998 | Rusch et al. | 156/108 |
| 5,802,960 | A | * | 9/1998 | Graj et al. | 99/403 |
| 5,979,015 | A | | 11/1999 | Tamaribuchi | |
| 6,484,361 | B1 | * | 11/2002 | Schmid et al. | 16/110.1 |
| D470,985 | S | * | 2/2003 | Zemel | D32/48 |
| 6,598,266 | B1 | | 7/2003 | Elliott | |
| 6,598,302 | B1 | * | 7/2003 | Peppel et al. | 30/340 |
| 2003/0146632 | A1 | * | 8/2003 | Marion et al. | 294/51 |

FOREIGN PATENT DOCUMENTS

| | | | |
|---|---|---|---|
| GB | 907520 | * | 10/1962 |

* cited by examiner

*Primary Examiner*—Robert J Sandy
(74) *Attorney, Agent, or Firm*—Welsh & Flaxman LLC

(57) ABSTRACT

An ergonomic handle offers users the choice of horizontally or vertically gripping an appliance attached thereto. The handle includes a first handle member shaped and dimensioned for gripping by an individual. The first handle member has a first longitudinal axis. The handle also includes a second handle member shaped and dimensioned for gripping by an individual. The second handle member has a second longitudinal axis. The first handle member and the second handle member are connected such that the second longitudinal axis of the second handle member is oriented approximately perpendicular relative to the first longitudinal axis of the first handle member.

9 Claims, 5 Drawing Sheets

ERGONOMIC HANDLE PROVIDING HORIZONTAL AND VERTICAL GRIPPING SURFACES

CROSS REFERENCE TO RELATED APPLICATIONS

The application relates to U.S. Provisional Patent Ser. No. 60/420,791, entitled "ERGONOMIC HANDLE PROVIDING HORIZONTAL AND VERTICAL GRIPPING SURFACES", filed Oct. 24, 2002.

BACKGROUND OF THE INVENTION

1. Field of the Invention

The invention relates to an ergonomic handle. More particularly, the invention relates to an ergonomic handle offering users the ability to grip an appliance with their hand oriented either horizontally or vertically.

2. Description of the Prior Art

A wide variety of handles have been developed in an effort to assist people in using appliances. Many of these handles include surfaces enhancing the ability of the user to comfortably grip the handle, and ultimately maneuver the appliance.

However, most grips only offer the user the choice of gripping the handle in a single orientation. Users are, therefore, often required to position their hands and arms in uncomfortable positions such that the appliance is held in a desired orientation. This is highly undesirable.

As such, need exists for a handle permitting users to grip the handle in a variety of orientations. The present invention provides such a handle.

SUMMARY OF THE INVENTION

It is, therefore, an object of the present invention to provide an ergonomic handle offering users the choice of horizontally or vertically gripping an appliance attached thereto. The handle includes a first handle member shaped and dimensioned for gripping by an individual. The first handle member has a first longitudinal axis. The handle also includes a second handle member shaped and dimensioned for gripping by an individual. The second handle member has a second longitudinal axis. The first handle member and the second handle member are connected such that the second longitudinal axis of the second handle member is oriented approximately perpendicular relative to the first longitudinal axis of the first handle member.

It is also an object of the present invention to provide an ergonomic handle wherein the first handle member is oriented for substantially horizontal gripping when a user attempts to use the appliance.

It is another object of the present invention to provide an ergonomic handle wherein the second handle member is oriented for substantially vertical gripping when a user attempts to use the appliance.

It is a further object of the present invention to provide an ergonomic handle wherein the first handle member includes a first end and a second end, the second handle member includes a first end and a second end, and the first end of the first handle member is connected to the second handle member.

It is still a further object of the present invention to provide an ergonomic handle wherein the first end of the first handle member is provided with a reduced diameter when compared to a central portion of the first handle member, the first end of the first handle member being shaped and dimensioned to accommodate the palm and fingers of a hand of a user.

It is yet a further object of the present invention to provide an ergonomic handle wherein the first end of the first handle member further includes an indentation shaped and dimensioned for receipt by a thumb of a user.

It is also another object of the present invention to provide an ergonomic handle wherein the second end of the first handle member is provided with a swivel member shaped and dimensioned for positioning of a thumb of a user thereon.

It is also an object of the present invention to provide an ergonomic handle wherein a far end of the swivel member includes a ridge aiding a user in positioning a hand thereon by providing the user with a ready indicator as to a tip of the first handle member.

It is a further object of the present invention to provide an ergonomic handle wherein the first end of the second handle member is connected directly to the appliance and the second end of the second handle member is connected to the first end of the first handle member.

It is another object of the present invention to provide an ergonomic handle wherein the first end of the second handle member is provided with a reduced diameter when compared to a central portion of the second handle member, the first end of the second handle member being shaped and dimensioned to accommodate the palm and fingers of a hand of a user as he or she grips the second handle member.

It is also an object of the present invention to provide an ergonomic handle including a positioning projection at a connection between the first handle member and the second handle member.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
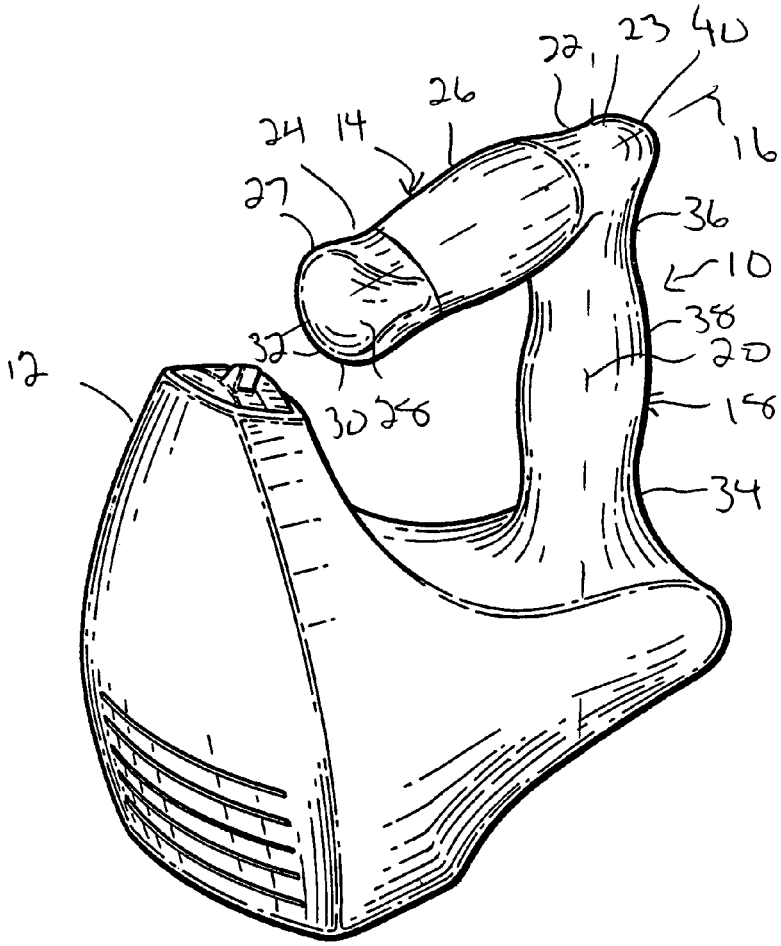
FIG. 1 is a perspective view of the handle in accordance with the present invention attached to a mixer body.
Figure 2:
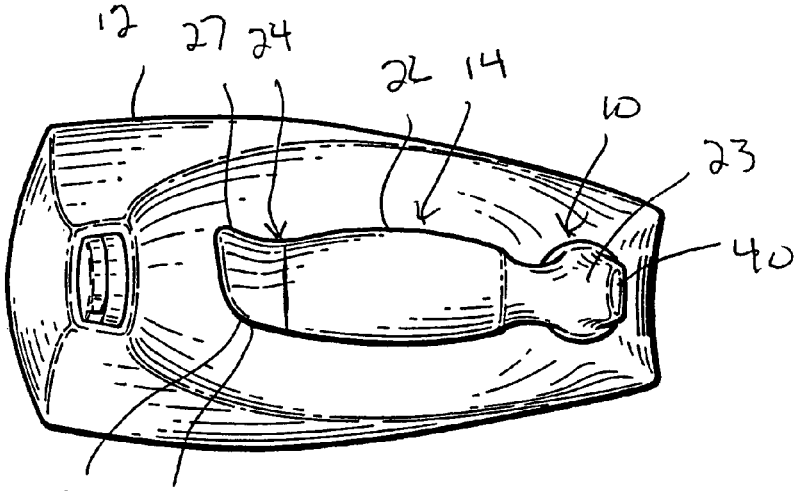
FIG. 2 is a top view of the present handle attached to a mixer body.
Figure 7:
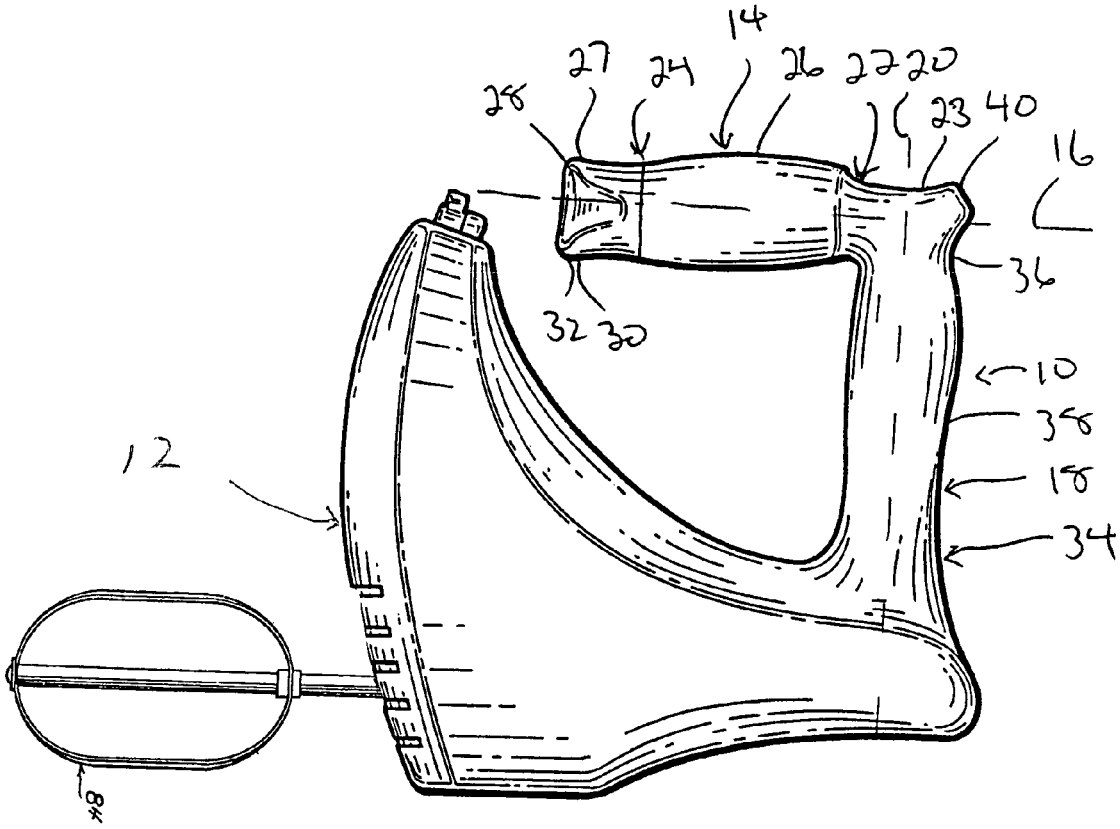
FIG. 7 is a side view (opposite that shown in FIG. 6) of the present mixer body utilizing the present handle.
Figure 3:
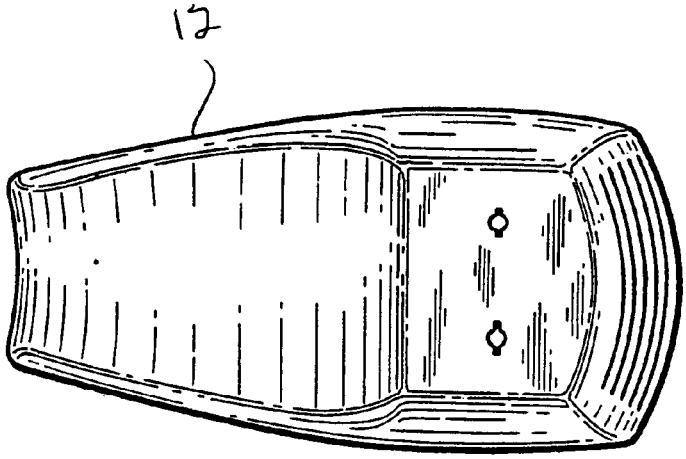
FIG. 3 is a bottom view of a mixer body including the present handle.
Figure 6:
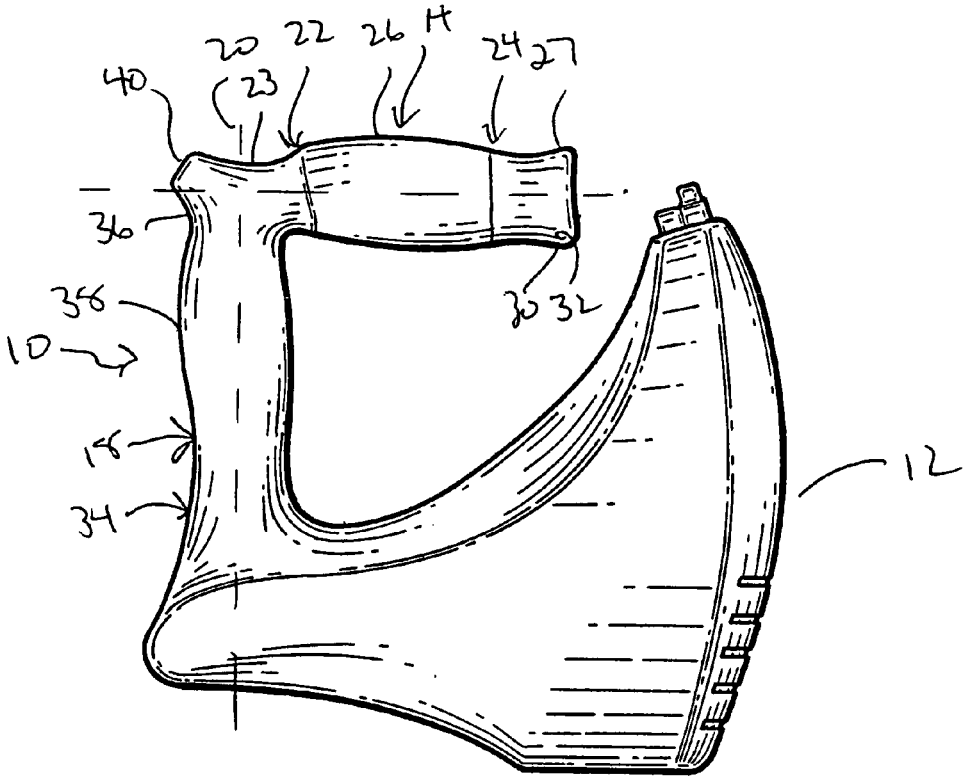
FIG. 6 is a side view of a mixer body utilizing the present handle.
Figure 4:
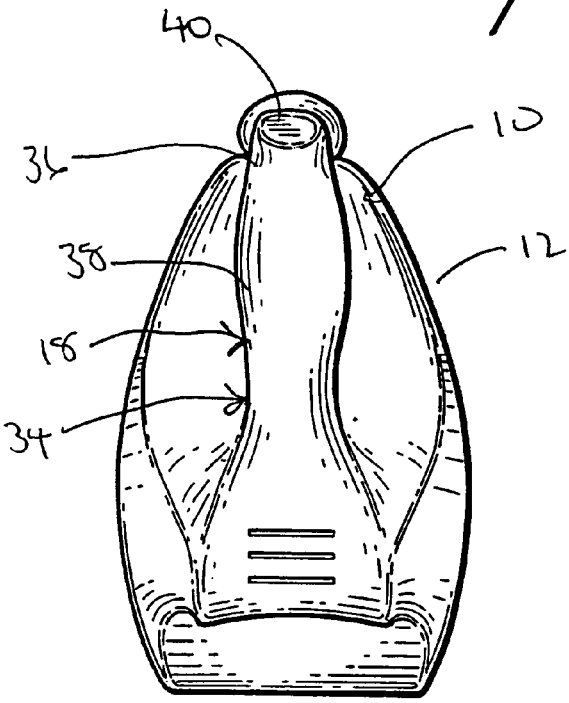
FIG. 4 is a rear view of a mixer body incorporating the present handle.
Figure 5:
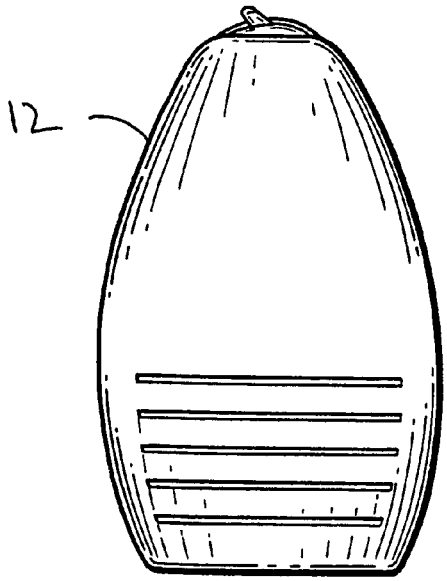
FIG. 5 is a front view of a mixer body utilizing the present handle.

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 to 7, an ergonomic handle 10 is disclosed. The handle 10 offers users the choice of horizontally or vertically gripping an appliance 12 attached thereto. In accordance with a preferred embodiment of the present invention, the handle 10 is designed for use in conjunction with a standard mixer 12 having a working implement 84 (for example, a beating element) extending therefrom. However, those skilled in the art will appreciate the many possible applications for the present handle 10, for example, for use with irons, portable hand mixers, power tools, etc.

The handle 10 is described below with reference to its use in conjunction with a standard mixer 12, although those skilled in the art will certainly appreciate the way in which the handle 10 might be applied for use with other appliances and tools. Generally, the handle 10 includes a first handle member 14 having a first longitudinal axis 16 which is generally parallel to the axis of the working implement 84 and a second handle member 18 having a second longitudinal axis 20 which is generally perpendicular to the axis of the working implement 84. The first handle member 14 and the second handle member 18 are connected such that the second longitudinal axis 20 of the second handle member 18 is oriented approximately perpendicular relative to the first longitudinal axis 16 of the first handle member 14.

More specifically, the handle 10 includes a first handle member 14 shaped and dimensioned for gripping by an individual. The first handle member 14 is oriented for substantially horizontal gripping when a user attempts to use the appliance 12. The first gripping member 14 also includes a first longitudinal axis 16 extending between a first end 22 of the first handle member 14 and a second end 24 of the first handle member 14, wherein the first end 22 of the first handle member 14 is connected to the second handle member 18.

The first handle member 14 is contoured so as to conform to the hand of a user. With this in mind, the first end 22 of the first handle member 14 is provided with a reduced diameter shaped and dimensioned to accommodate the palm and fingers of a user's hand as he or she grips the first handle member 14. The first end 22 of the first handle member 14 may further be formed with an indentation 23 shaped and dimensioned for receipt by a user's thumb as he or she grips the second handle member 18. The central portion 26 of the first handle member 14 gradually increases in diameter as it extends from the first end 22 of the first handle member 14 and decreases in diameter as it extends toward the second end 24 of the first handle member 14. As with the first end 22 of the first handle member 14, the second end 24 of the first handle member 14 has a slightly reduced diameter to accommodate comfortable gripping by an individual using the handle 10.

The second end 24 of the first handle member 14 is provided with a swivel member 27 having a recess 28 shaped and dimensioned for positioning of a user's thumb thereon. The swivel member 27 is shaped and dimensioned to be continuous in shape with the remainder of the first handle member 14. In addition, the far end 30 of the swivel member 27 includes an increased diameter ridge 32. The increased diameter ridge 32 aids a user in positioning his or her hand thereon by providing the user with a ready indicator as to the tip of the first handle member 14.

The handle 10 also includes a second handle member 18 shaped and dimensioned for gripping by an individual. The second handle member 18 is oriented for substantially vertical gripping when a user attempts to use the appliance 12. The second handle member 18 also includes a first longitudinal axis 20 extending between a first end 34 of the second handle member 18 and a second end 36 of the second handle member 18. The first end 34 of the second handle member 18 is connected directly to the appliance 10 and the second end 36 of the second handle member 18 is connected to the first end 22 of the first handle member 14.

As with the first handle member 14, the second handle member 18 is contoured so as to conform to the hand of a user. With this in mind, the first end 34 of the second handle member 18 (adjacent its point of connection with the mixer 12) is provided with a reduced diameter shaped and dimensioned to accommodate the palm and fingers of a user's hand as he or she grips the second handle member 18. The central portion 38 of the second handle member 18 gradually increases in diameter as it extends from the first end 34 of the second handle member 18 and decreases in diameter as it extends toward the second end 36 of the second handle member 18. As with the first end 34 of the second handle member 18, the second end 36 of the second handle member 18 has a slightly reduced diameter to accommodate comfortable gripping by an individual using the handle 10.

A projection 40 is formed along the connection point between the first handle member 14 and the second handle member 18. The projection 40 aids a user in positioning his or her hand thereon by providing the user with a ready indicator as to the second end 36 of the second handle member 18 and the first end 22 of the first handle member 14.

As mentioned above, the first handle member 14 and the second handle member 18 are connected such that the second longitudinal axis 20 of the second handle member 18 is oriented approximately perpendicular relative to the first longitudinal axis 16 of the first handle member 14. By providing a first handle member 14 allowing a user to grip an appliance 12 in a horizontally oriented manner and providing a second handle member 18 allowing a user to grip an appliance 12 in a vertically oriented manner, a user is afforded the choice as to which handle member is the most comfortable for the job being undertaken. As such, a user may hold the appliance 12 in the most natural position, offering users additional comfort and enjoyment as they use the appliance 12.

Figure 10:
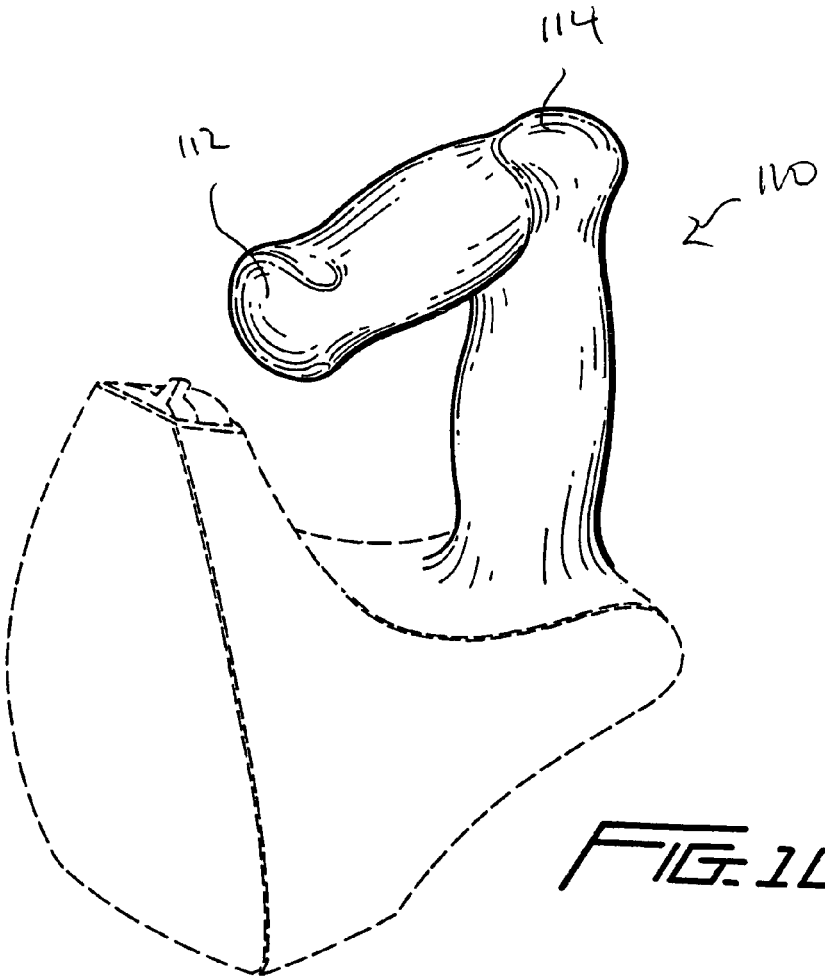
FIG. 10 is a front perspective view of the embodiment disclosed with reference to FIG. 8.
Figure 8:
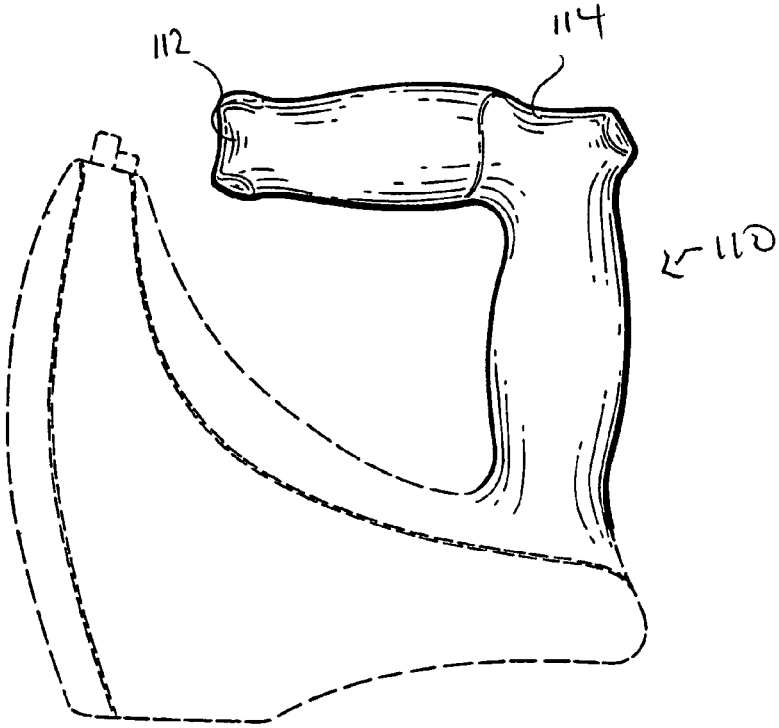
FIG. 8 is a side view of an alternate embodiment of the present handle with the mixer body shown in broken lines.
Figure 9:
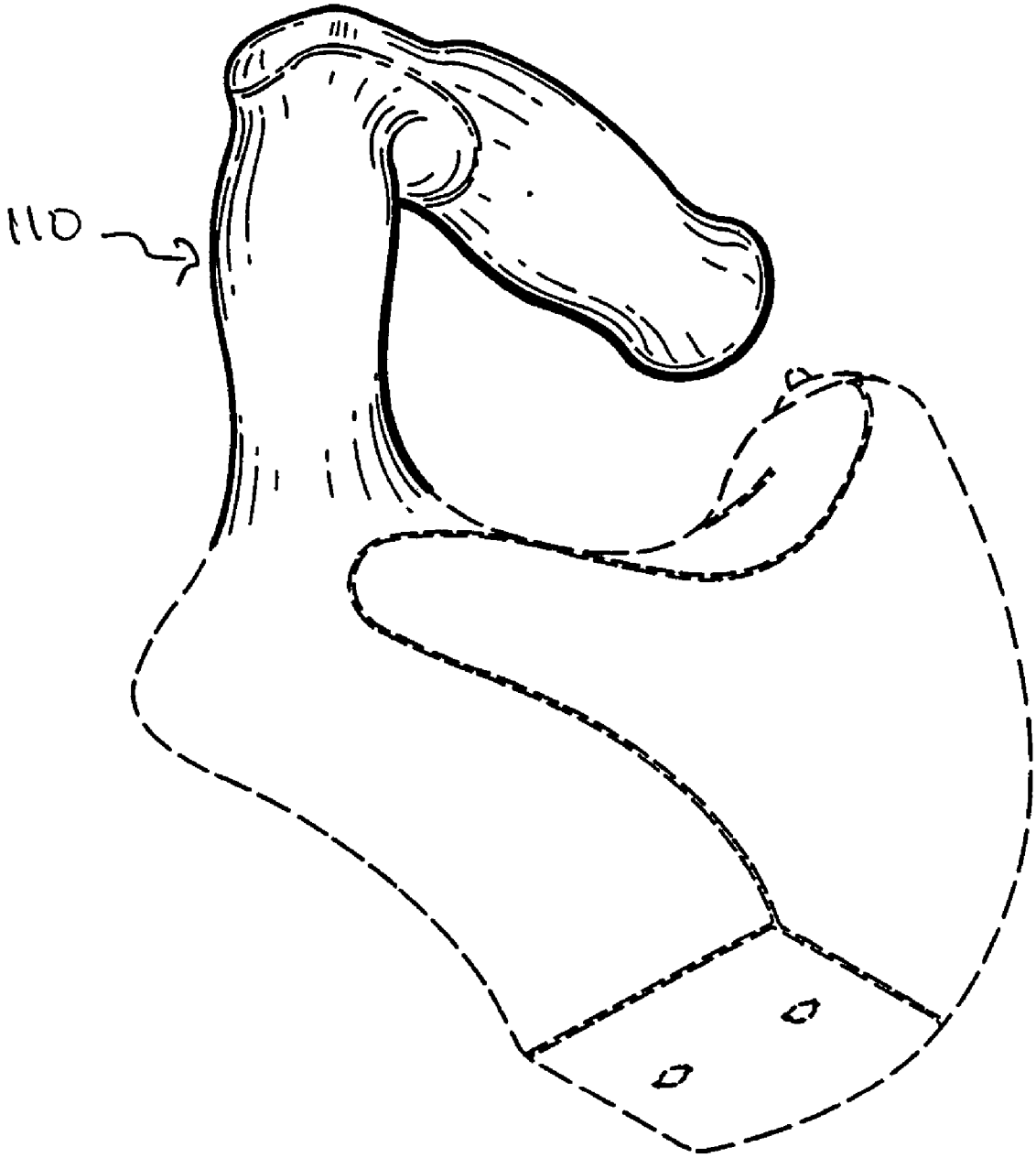
FIG. 9 is a bottom perspective view of the embodiment disclosed with reference to FIG. 8.

With reference to FIGS. 8 to 10 an alternate embodiment of the present ergonomic handle 110 is disclosed. This embodiment is functionally equivalent to the embodiment disclosed with reference to FIGS. 1 to 7, but is designed for use by only right-handed individuals. Specifically, the swivel 27 of the embodiment disclosed with reference to FIGS. 1 to 7 has been removed, and specifically shaped thumb recesses 112, 114 have been provided for orienting the hand of a user gripping the present handle 110.

While the preferred embodiments have been shown and described, it will be understood that there is no intent to limit the invention by such disclosure, but rather, is intended to cover all modifications and alternate constructions falling within the spirit and scope of the invention as defined in the appended claims.

The invention claimed is:

1. An appliance giving having an ergonomic handle offering users the choice of horizontally or vertically gripping the handle, comprising:

a first handle member shaped and dimensioned for gripping by an individual, the first handle member having a first longitudinal axis, a first end and a second end, and upper and lower surfaces;

a second handle member shaped and dimensioned for gripping by an individual, the second handle member having a second longitudinal axis, a first end and a second end, wherein the first end of the second handle member is the only portion of the handle connected to the appliance;

the first handle member and the second handle member being connected such that the second longitudinal axis of the second handle member is oriented approximately perpendicular relative to the first longitudinal axis of the first handle member, and wherein the first end of the first handle member is connected to the second end of the second handle member, the second end of the first handle member is free and unconnected to the appliance, and the first end of the second handle member is connected directly to the appliance with the appliance extending downwardly therefrom along the second longitudinal axis of the second handle member.

2. The appliance with ergonomic handle according to claim 1, wherein the first handle member is oriented for substantially horizontal gripping when a user attempts to use the appliance.

3. The appliance with ergonomic handle according to claim 1, wherein the second handle member is oriented for substantially vertical gripping when a user attempts to use the appliance.

4. The appliance with ergonomic handle according to claim 1, wherein the first end of the first handle member is provided with a reduced diameter when compared to a central portion of the first handle member, the first end of the first handle member being shaped and dimensioned to accommodate the palm and fingers of a hand of a user.

5. The appliance with ergonomic handle according to claim 4, wherein the first end of the first handle member further includes an indentation shaped and dimensioned for receipt by a thumb of a user on the upper surface thereof.

6. The appliance with ergonomic handle according to claim 1, wherein the second end of the first handle member is provided with a swivel member shaped and dimensioned for positioning of a thumb of a user thereon at the free end thereof, the swivel member being shaped and dimensioned to be continuous in shape with the remainder of the first handle member.

7. The appliance with ergonomic handle according to claim 6, wherein a far end of the swivel member includes a ridge aiding a user in positioning a hand thereon by providing the user with a ready indicator as to a tip of the first handle member.

8. The appliance with ergonomic handle according to claim 1, further including a positioning projection at a connection between the first handle member and the second handle member.

9. The appliance with ergonomic handle according to claim 1, wherein the appliance is a hand held mixer.

* * * * *